United States Patent [19]

Waynick

[11] Patent Number: 4,902,435

[45] **Date of Patent: * Feb. 20, 1990**

[54] GREASE WITH CALCIUM SOAP AND POLYUREA THICKENER

[75] Inventor: John A. Waynick, Bolingbrook, Ill.

[73] Assignee: Amoco Corporation, Chicago, Ill.

[ * ] Notice: The portion of the term of this patent subsequent to Nov. 29, 2005 has been disclaimed.

[21] Appl. No.: 223,268

[22] Filed: Jul. 22, 1988

Related U.S. Application Data

[63] Continuation-in-part of Ser. No. 830,710, Feb. 18, 1986, abandoned, and a continuation of Ser. No. 53,262, May 22, 1986, Pat. No. 4,787,992.

[51] Int. Cl.[4] ..... C10M 125/00; C10M 135/10

[52] U.S. Cl. ..... 252/18; 252/32.5; 252/51.5 R

[58] Field of Search ..... 252/16, 17, 18, 32, 252/32.5, 38, 51.5 R

[56] References Cited

U.S. PATENT DOCUMENTS

| | | | |
|---|---|---|---|
| 4,107,058 | 8/1978 | Clarke et al. | 252/18 |
| 4,305,831 | 12/1981 | Johnson, III et al. | 252/18 |
| 4,440,658 | 4/1984 | Piotrowski et al. | 252/51.5 |
| 4,787,992 | 11/1988 | Waynick | 252/18 |

*Primary Examiner*—Ferris H. Lander

*Attorney, Agent, or Firm*—Thomas W. Tolpin; William H. Magidson; Ralph C. Medhurst

[57] ABSTRACT

A high performance lubricating grease effectively lubricates and greases front-wheel drive joints. The front-wheel drive grease has excellent extreme pressure properties and antiwear qualities and is economical, non-toxic and safe. In one preferred form, the front-wheel drive grease comprises a base oil, a thickener comprising polyurea and calcium complex soap, and an additive package comprising tricalcium phosphate and calcium carbonate.

6 Claims, No Drawings

GREASE WITH CALCIUM SOAP AND POLYUREA THICKENER

CROSS REFERENCES TO RELATED APPLICATION

This patent application is a continuation-in-part of the patent application of John Andrew Waynick, Ser. No. 830,710, filed Feb. 18, 1986, now abandoned entitled: Front-Wheel Drive Grease and a continuation of the patent application of John Andrew Waynick, Ser. No. 07/053,262 filed May 22, 1986, entitled: Calcium Soap Thickened Front-Wheel Drive Grease and now U.S. Pat. No. 4,787,992, issued Nov. 29, 1988.

BACKGROUND OF THE INVENTION

This invention pertains to lubricants and, more particularly, to a lubricating grease which is particularly useful for drive joints of front-wheel drive vehicles.

In front-wheel drive automobiles, vans, and trucks, the front wheels are driven by the engine via a front axle assembly and a number of front-wheel drive joints. These front-wheel drive joints facilitate movement of the front axle assembly while maintaining constant rotational velocity between the front wheels. The front-wheel drive joint is often referred to as a constant velocity (CV) joint. The outer CV joint usually has an outer boot comprising an elastomer, such as polyester or neoprene; the inner CV joint usually has a boot comprising a higher temperature-resistant elastomer, such as silicon-based elastomers.

Front-wheel drive joints experience extreme pressures, torques, and loads during use. Operating temperatures can vary from −40° F. during winter to over 300° F. during summer.

Front-wheel drive greases are required to provide wear resistance. When a front-wheel drive vehicle is driven, sliding, rotational, and oscillatory (fretting) motions simultaneously occur within the front-wheel drive joint, along with large loads and torques. A grease which minimizes wear from one of these motions or conditions will not necessarily protect against the others.

Front-wheel drive greases are also required to be chemically compatible with the elastomers and seals in front-wheel drive joints. Such greases should not chemically corrode, deform, or degrade the elastomers and seals which could cause swelling, hardening, loss of tensile strength, and ultimately rupture, oil leakage, and mechanical failure of the CV joints and seals.

Over the years, a variety of greases have been suggested for use with front-wheel drive joints and/or other mechanisms. Typifying such greases are those found in U.S. Pat. Nos. 2,964,475, 2,967,151, 3,344,065, 3,843,528, 3,846,314, 3,920,571, 4,100,080, 4,107,058, 4,305,831, 4,431,552, 4,392,967, 4,440,658, 4,514,312, and Re. 31,611. These greases have met with varying degrees of success.

It is, therefore, desirable to provide an improved front-wheel drive grease which overcomes most, if not all, of the above problems.

SUMMARY OF THE INVENTION

An improved lubricating grease is provided which is particularly useful for front-wheel drive joints. The novel grease displayed unexpectedly surprisingly good results over prior art greases. The new grease provides superior wear protection from sliding, rotational, and oscillatory (fretting) motions in front-wheel drive joints. It is also chemically compatible with elastomers and seals in front-wheel drive joints. It further resists chemical corrosion, deformation, and degradation of the elastomers and extends the useful life of CV (constant velocity) drive joints.

The novel grease performs well at high temperatures and over long periods of time. It exhibits excellent stability, superior fretting wear qualities, and good oil separation properties even at high temperatures. Advantageously, the grease is economical to manufacture and can be produced in large quantities.

To this end, the improved lubricating grease has: (a) a substantial proportion of a base oil, (b) a thickener, such as simple calcium soap, calcium complex soap, and/or polyurea, triurea, or biurea, and (c) a sufficient amount of an additive package to impart extreme pressure properties to the grease.

In one form, the additive package comprises tricalcium phosphate. Tricalcium phosphate provides many unexpected surprisingly good advantages over monocalcium phosphate and dicalcium phosphate. For example, tricalcium phosphate is water insoluble and will not be extracted from the grease if contacted with water. Tricalcium phosphate is also very compatible with the elastomers and seals in front-wheel drive joints.

On the other hand, monocalcium phosphate and dicalcium phosphate are water soluble. When water comes into significant contact with monocalcium or dicalcium phosphate, they have a tendency to leach, run, extract, and wash out of the grease. This destroys any significant antiwear and extreme pressure qualities of the grease. Monocalcium phosphate and dicalcium phosphate are also protonated and have acidic hydrogen present which can adversely react, crack, degrade, and corrode seals and elastomers.

In another form, the additive package comprises carbonates and phosphates together in the absence of sulfides, such as insoluble arylene sulfide polymers. The carbonates are of a Group 2*a* alkaline earth metal, such as beryllium, manganese, calcium, strontium, and barium, or of a Group 1*a* alkali metal, such as lithium, sodium, and potassium. The phosphates are of a Group 2*a* alkaline earth metal, such as those described above, or a Group 1*a* alkali metal such as those described above. Calcium carbonate and tricalcium phosphate are preferred for best results because they are economical, stable, nontoxic, water insoluble, and safe.

The use of both carbonates and phosphates in the additive packages produced unexpected surprisingly good results over the use of greater amounts of either carbonates alone or phosphates alone. For example, the use of both carbonates and phosphates produced superior wear protection in comparison to a similar grease with a greater amount of carbonates in the absence of phosphates, or a similar grease with a greater amount of phosphates in the absence of carbonates.

Furthermore, the combination of the above carbonates and phosphates in the absence of sulfides, such as insoluble arylene sulfide polymers, achieved unexpected surprisingly good results over that combination with sulfides, such as insoluble arylene sulfide polymers. It was found that applicant's combination attained superior extreme pressure properties and antiwear qualities as well as superior elastomer compatibility, while the addition of insoluble arylene sulfide polymers caused abrasion, corroded copper, degraded elastomers and seals, and significantly weakened their tensile strength and elastomeric qualities. Insoluble arylene sulfide polymers are also very expensive, making their use in lubricants prohibitively costly.

The use of a thickener comprising both calcium complex soap and polyurea was unexpectedly and surprisingly superior in many respects to a thickener consisting of only calcium complex soap, polyurea, or simple calcium soap.

While the novel lubricating grease is particularly useful for front-wheel drive joints, it can also be advantageously used in universal joints and in bearings which are subjected to heavy shock loads, fretting, and oscillating motions. It can also be used as a railroad track lubricant on the sides of a railroad track. It can further be used in high temperature applications, such as in steel mills.

A more detailed explanation of the invention is provided in the following description and appended claims.

DESCRIPTION OF THE PREFERRED EMBODIMENTS

A high performance lubricating grease is provided to effectively lubricate and grease a front-wheel drive joint. The novel front-wheel drive grease exhibits excellent extreme pressure (EP) properties and antiwear qualities and is economical, nontoxic, and safe.

The front-wheel drive grease is chemically compatible and substantially inert to the elastomers and seals of front-wheel drive joints and provides a protective lubricating coating for the drive joints. It will not significantly corrode, deform, or degrade silicon-based elastomers of the type used in the inner front-wheel drive joints, even at high temperatures experienced in prolonged desert driving. Nor will it significantly corrode, deform, or degrade front-wheel drive seals with minimal overbasing from calcium oxide or calcium hydroxide. It further will not corrode, deform, or degrade polyester and neoprene elastomers of the type used in the outer front-wheel drive joints and boots and substantially helps prevent the elastomers from cracking and becoming brittle during prolonged winter driving. It is also chemically inert to steel and copper even at the high temperatures which can be encountered in front-wheel drive joints.

The grease is an excellent lubricant between contacting metals and/or elastomeric plastics. It provides superior protection against fretting wear caused by repetitive oscillating and jostling motions of short amplitude, such as experienced by new cars during shipment by truck or railroad. It also provides outstanding protection against dynamic wear caused by sliding, rotational and oscillating motions of large amplitudes, of the type experienced in rigorous prolonged highway and mountain driving. It further accommodates rapid torque and loading increases during acceleration and sudden heavy shock loads when a front-wheel drive vehicle rides over fields, gravel roads, potholes, and bumps.

The preferred lubricating grease comprises by weight: 45% to 85% base oil, 1% to 20% thickener comprising polyurea and/or calcium complex soap, and 4% to 40% extreme pressure wear-resistant additives. For best results, the front-wheel drive lubricating grease comprises by weight: at least 70% base oil, 3% to 16% thickener comprising polyurea and/or calcium complex soap, and 6% to 20% extreme pressure wear-resistant additives.

Sulfides, including insoluble arylene sulfide polymers, should be avoided in the grease because such sulfides: (1) corrode copper and other metals, (2) degrade, deform, and corrode silicon seals, (3) significantly diminish the tensile strength and elastomeric properties of many elastomers, (4) chemically attack and are incompatible with inner silicon front-wheel drive joints, (5) exhibit inferior fretting wear, and (6) are abrasive.

Inhibitors

The additive package may be complemented by the addition of small amounts of an antioxidant and a corrosion inhibiting agent, as well as dyes and pigments to impart a desired color to the composition.

Antioxidants or oxidation inhibitors prevent varnish and sludge formation and oxidation of metal parts. Typical antioxidants are organic compounds containing nitrogen, such as organic amines, sulfides, hydroxy sulfides, phenols, etc., alone or in combination with metals like zinc, tin, or barium, as well as phenylalphanaphthyl amine, bis(alkylphenyl)amine, N,N - diphenyl-p-phenylenediamine, 2,2,4 - trimethyldihydroquinoline oligomer, bis(4 - isopropylaminophenyl)-ether, N-acyl-p-aminophenol, N - acylphenothiazines, N - hydrocarbylamides of ethylenediamine tetraacetic acid, and alkylphenol-formaldehyde-amine polycondensates.

Corrosion inhibiting agents or anticorrodents prevent rusting of iron by water, suppress attack by acidic bodies, and form protective film over metal surfaces to diminish corrosion of exposed metallic parts. A typical corrosion inhibiting agent is an alkali metal nitrite, such as sodium nitrate. Other ferrous corrosion inhibitors include metal sulfonate salts, alkyl and aryl succinic acids, and alkyl and aryl succinate esters, amides, and other related derivatives. Borated esters, amines, ethers, and alcohols can also be used with varying success to limit ferrous corrosion.

Metal deactivators can also be added to prevent or diminish copper corrosion and counteract the effects of metal on oxidation by forming catalytically inactive compounds with soluble or insoluble metal ions. Typical metal deactivators include mercaptobenzothiazole, complex organic nitrogen, and amines.

Stabilizers, tackiness agents, dropping-point improvers, lubricating agents, color correctors, and/or odor control agents can also be added to the additive package.

Base Oil

The base oil can be naphthenic oil, paraffinic oil, aromatic oil, or a synthetic oil such as a polyalphaolefin (PAO), polyester, diester, polyether, polyolether, fluoronated or polyfluoronated derivative of any of these preceding fluids, or combinations thereof. The viscosity of the base oil can range from 50 to 10,000 SUS at 100° F.

Other hydrocarbon oils can also be used, such as: (a) oil derived from coal products, (b) alkylene polymers, such as polymers of propylene, butylene, etc., (c) alkylene oxide-type polymers, such as alkylene oxide polymers prepared by polymerizing alkylene oxide (e.g., propylene oxide polymers, etc., in the presence of water or alcohols, e.g., ethyl alcohol), (d) carboxylic acid esters, such as those which were prepared by esterifying such carboxylic acids as adipic acid, azelaic acid, suberic acid, sebacic acid, alkenyl succinic acid, fumaric acid, maleic acid, etc., with alcohols such as butyl alcohol, hexyl alcohol, 2-ethylhexyl alcohol, etc., (e) liquid esters of acid of phosphorus, (f) alkyl benzenes, (g) polyphenols such as biphenols and terphenols, (h) alkyl biphenol ethers, and (i) polymers of silicon, such as tetraethyl silicate, tetraisopropyl silicate, tetra(4-methyl-2-tetraethyl) silicate, hexyl(4-methol-2-pentoxy) disilicone, poly(methyl)siloxane, and poly(methyl)-phenylsiloxane.

The preferred base oil comprises about 60% by weight of a refined solvent-extracted hydrogenated dewaxed base oil, preferably 850 SUS oil, and about 40% by weight of another refined solvent-extracted hydrogenated dewaxed base oil, preferably 350 SUS oil, for better results.

Thickener

Polyurea thickeners are preferred over other types of thickeners because they have high dropping points and have intrinsic antioxidant properties. The polyurea thickener imparts a dropping point of usually about 450° to about 500° F. Polyurea thickeners are also advantageous because they have inherent antioxidant characteristics, work well with other antioxidants, and are compatible with all the elastomers and seals of front-wheel drive joints.

The polyurea comprising the thickener can be prepared in a pot, kettle, bin, or other vessel by reacting an amine, such as a fatty amine, with diisocyanate, or a polymerized diisocyanate, and water. Other amines can also be used.

EXAMPLE 1

Polyurea thickener was prepared in a pot by adding: (a) about 30% by weight of a solvent extracted neutral base oil containing less than 0.1% by weight sulfur with a viscosity of 600 SUS at 100° F. and (b) about 7.45% by weight of primary oleyl amine. The primary amine base oil was then mixed for 30–60 minutes at a maximum temperature of 120° F. with about 5.4% by weight of an isocyanate, such as 143 L-MDI manufactured by Upjohn Company. About 3% by weight water was then added and stirred for about 20 to 30 minutes, before removing excess free isocyanates and amines.

The polyurea thickener can also be prepared, if desired, by reacting an amine and a diamine with diisocyanate in the absence of water. For example, polyurea can be prepared by reacting the following components:

1. A diisocyanate or mixture of diisocyanates having the formula OCN-R-NCO, wherein R is a hydrocarbylene having from 2 to 30 carbons, preferably from 6 to 15 carbons, and most preferably 7 carbons;
2. A polyamine or mixture of polyamines having a total of 2 to 40 carbons and having the formula:

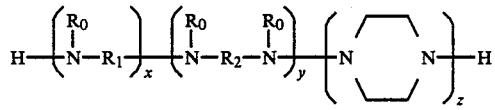

wherein $R_1$ and $R_2$ are the same or different types of hydrocarbylenes having from 1 to 30 carbons, and preferably from 2 to 10 carbons, and most preferably from 2 to 4 carbons; $R_0$ is selected from hydrogen or a C1–C4 alkyl, and preferably hydrogen; x is an integer from 0 to 4; y is 0 or 1; and z is an integer equal to 0 when y is 1 and equal to 1 when y is 0.

3. A monofunctional component selected from the group consisting of monoisocyanate or a mixture of monoisocyanates having 1 to 30 carbons, preferably from 10 to 24 carbons, a monoamine or mixture of monoamines having from 1 to 30 carbons, preferably from 10 to 24 carbons, and mixtures thereof.

The reaction can be conducted by contacting the three reactants in a suitable reaction vessel at a temperature between about 60° F. to 320° F., preferably from 100° F. to 300° F., for a period of 0.5 to 5 hours and preferably from 1 to 3 hours. The molar ratio of the reactants present can vary from 0.1–2 molar parts of monoamine or monoisocyanate and 0–2 molar parts of polyamine for each molar part of diisocyanate. When the monoamine is employed, the molar quantities can be (m+1) molar parts of diisocyanate, (m) molar parts of polyamine and 2 molar parts of monoamine. When the monoisocyanate is employed, the molar quantities can be (m) molar parts of diisocyanate, (m+1) molar parts of polyamine and 2 molar parts of monoisocyanate (m is a number from 0.1 to 10, preferably 0.2 to 3, and most preferably 1).

Mono- or polyurea compounds can have structures defined by the following general formula:

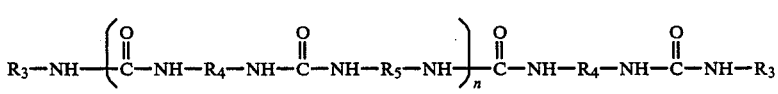

(1)

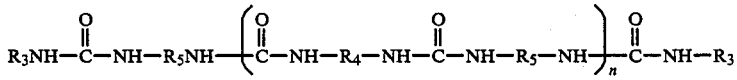

(2)

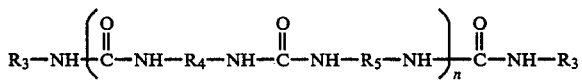

(3)

wherein n is an integer from 0 to 3; $R_3$ is the same or different hydrocarbyl having from 1 to 30 carbon atoms, preferably from 10 to 24 carbons; $R_4$ is the same or different hydrocarbylene having from 2 to 30 carbon atoms, preferably from 6 to 15 carbons; and $R_5$ is the same or different hydrocarbylene having from 1 to 30 carbon atoms, preferably from 2 to 10 carbons.

As referred to herein, the hydrocarbyl group is a monovalent organic radical composed essentially of hydrogen and carbon and may be aliphatic, aromatic, alicyclic, or combinations thereof, e.g., aralkyl, alkyl, aryl, cycloalkyl, alkylcycloalkyl, etc., and may be saturated or olefinically unsaturated (one or more doublebonded carbons, conjugated, or nonconjugated). The hydrocarbylene, as defined in $R_1$ and $R_2$ above, is a divalent hydrocarbon radical which may be aliphatic, alicyclic, aromatic, or combinations thereof, e.g., alkylaryl, aralkyl, alkylcycloalkyl, cycloalkylaryl, etc., having its two free valences on different carbon atoms.

The mono- or polyureas having the structure presented in Formula 1 above are prepared by reacting (n+1) molar parts of diisocyanate with 2 molar parts of a monoamine and (n) molar parts of a diamine. (When n equals zero in the above Formula 1, the diamine is deleted). Mono- or polyureas having the structure presented in Formula 2 above are prepared by reacting (n) molar parts of a diisocyanate with (n+1) molar parts of a diamine and 2 molar parts of a monoisocyanate. (When n equals zero in the above Formula 2, the diisocyanate is deleted). Mono- or polyureas having the structure presented in Formula 3 above are prepared by reacting (n) molar parts of a diisocyanate with (n) molar parts of a diamine and 1 molar part of a monoisocyanate and 1 molar part of a monoamine. (When n equals zero in Formula 3, both the diisocyanate and diamine are deleted).

In preparing the above mono- or polyureas, the desired reactants (diisocyanate, monoisocyanate, diamine, and monoamine) are mixed in a vessel as appropriate. The reaction may proceed without the presence of a catalyst and is initiated by merely contacting the component reactants under conditions conducive for the reaction. Typical reaction temperatures range from 70° F. to 210° F. at atmospheric pressure. The reaction itself is exothermic and, by initiating the reaction at room temperature, elevated temperatures are obtained. External heating or cooling may be used.

The monoamine or monoisocyanate used in the formulation of the mono- or polyurea can form terminal end groups. These terminal end groups can have from 1 to 30 carbon atoms, but are preferably from 5 to 28 carbon atoms, and more desirably from 10 to 24 carbon atoms. Illustrative of various monoamines are: pentylamine, hexylamine, heptylamine, octylamine, decylamine, dodecylamine, tetradecylamine, hexadecylamine, octadecylamine, eicosylamine, dodecenylamine, hexadecenylamine, octadecenylamine, octadeccadienylamine, abietylamine, aniline, toluidine, naphthylamine, cumylamine, bornylamine, fenchylamine, tertiary butyl aniline, benzylamine, betaphenethylamine, etc. Preferred amines are prepared from natural fats and oils or fatty acids obtained therefrom. These starting materials can be reacted with ammonia to give first amides and then nitriles. The nitriles are reduced to amines by catalytic hydrogenation. Exemplary amines prepared by the method include: stearylamine, laurylamine, palmitylamine, oleylamine, petroselinylamine, linoleylamine, linolenylamine, eleostearylamine, etc. Unsaturated amines are particularly useful. Illustrative of monoisocyanates are: hexylisocyanate, decylisocyanate, dodecylisocyante, tetradecylisocyanate, hexadecylisocyanate, phenylisocyanate, cyclohexylisocyanate, xyleneisocyanate, cumeneisocyanate, abietylisocyanate, cyclooctylisocyanate, etc.

Polyamines which form the internal hydrocarbon bridges can contain from 2 to 40 carbons and preferably from 2 to 30 carbon atoms, more preferably from 2 to 20 carbon atoms. The polyamine preferably has from 2 to 6 amine nitrogens, preferably 2 to 4 amine nitrogens and most preferably 2 amine nitrogens. Such polyamines include: diamines such as ethylenediamine, propanediamine, butanediamine, hexanediamine, dodecanediamine, octanediamine, hexadecanediamine, cyclohexanediamine, cyclooctanediamine, phenylenediamine, tolylenediamine, xylylenediamine, dianiline methane, ditoluidinemethane, bis(aniline), bis(toluidine), piperazine, etc.; triamines, such as aminoethyl piperazine, diethylene triamine, dipropylene triamine, N-methyldiethylene triamine, etc., and higher polyamines such as triethylene tetraamine, tetraethylene pentaamine, pentaethylene hexamine, etc.

Representative examples of diisocyanates include: hexane diisocyanate, decanediisocyanate, octadecanediisocyanate, phenylenediisocyanate, tolylenediisocyanate, bis(diphenylisocyanate), methylene bis(phenylisocyanate), etc.

Other mono- or polyurea compounds which can be used are:

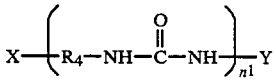

wherein $n^1$ is an integer of 1 to 3, $R_4$ is defined supra; X and Y are monovalent radicals selected from Table 1 below:

TABLE I

| X | Y |
|---|---|
| $R_7-\overset{O}{\overset{\|}{C}}-NH-$ | $R_7-\overset{O}{\overset{\|}{C}}-NH-R_5-$ |
| 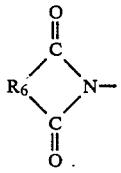 | 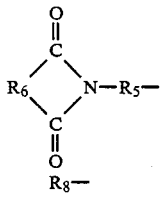 |

In Table 1, $R_5$ is defined supra, $R_8$ is the same as $R_3$ and defined supra, $R_6$ is selected from the groups consisting of arylene radicals of 6 to 16 carbon atoms and alkylene groups of 2 to 30 carbon atoms, and $R_7$ is selected from the group consisting of alkyl radicals having from 10 to 30 carbon atoms and aryl radicals having from 6 to 16 carbon atoms.

Mono- or polyurea compounds described by formula (4) above can be characterized as amides and imides of mono-, di-, and triureas. These materials are formed by reacting, in the selected proportions, suitable carboxylic acids or internal carboxylic anhydrides with a diisocyanate and a polyamine with or without a monoamine or monoisocyanate. The mono- or polyurea compounds are prepared by blending the several reactants together in a vessel and heating them to a temperature ranging from 70° F. to 400° F. for a period sufficient to cause formation of the compound, generally from 5 minutes to 1 hour. The reactants can be added all at once or sequentially.

The above mono- or polyureas can be mixtures of compounds having structures wherein n or $n^1$ varies from 0 to 8, or n or $n^1$ varies from 1 to 8, existent within the grease composition at the same time. For example, when a monoamine, a diisocyanate, and a diamine are all present within the reaction zone, as in the preparation of ureas having the structure shown in formula (2)

above, some of the monoamine may react with both sides of the diisocyanate to form diurea (biurea). In addition to the formulation of diurea, simultaneous reactions can occur to form tri-, tetra-, penta-, hexa-, octa-, and higher polyureas.

Biurea (diurea) may be used as a thickener, but it is not as stable as polyurea and may shear and loose consistency when pumped. If desired, triurea can also be included with or used in lieu of polyurea or biurea.

Calcium soap thickeners may also be used, although experience in the U.S. has indicated that polyurea thickener systems, as previously described are intrinsically superior. Calcium soap thickeners may be either simple soaps or complex soaps.

To make a calcium soap thickener requires a calcium containing base and a fatty monocarboxylic acid, ester, amide, anhydride, or other fatty monocarboxylic acid derivative. When the two materials are reacted together—usually while slurried dispersed, or otherwise suspended in a base oil—a calcium carboxylate salt, or mixture of salts is formed in the base oil. The calcium salt or salts formed thicken the oil, thereby facilitating a grease-like texture. During the reaction, water may or may not be present to assist in the formation of thickener. In earlier calcium grease technology some added water may be retained in the final calcium soap grease as "tie water." This water is required to give permanence to the grease consistency. If the grease is heated much above 212° F., the tie water is lost, and with it the grease consistency. Such hydrous calcium greases are referred to as "cup greases," and usually do not perform well as front-wheel drive greases where performance at temperatures of 300° F. are encountered.

Simple calcium soap thickened greases do not require tie water and are referred to as anhydrous calcium soap greases. Anhydrous simple calcium soap thickeners can be quite useful for front-wheel drive greases and can comprise a minor to a substantial portion of monocarboxylic acids or fatty acid derivatives, preferably a hydroxyl group on one or more of the carbon atoms of the fatty chain for better stability of grease structure. The added polarity afforded by this hydroxyl group eliminates the need for tie water. Anhydrous simple calcium soap thickened greases are best used at lower temperatures since their dropping points are usually within the range of 300° F. to 390° F.

The calcium base material used in the thickener can be calcium oxide, calcium carbonate, calcium bicarbonate, calcium hydroxide, or any other calcium containing substance which, when reacted with a monocarboxylic acid or monocarboxylic acid derivative, provides a calcium carboxylate thickener.

Desirably, monocarboxylic fatty acids or their derivatives used in simple calcium soap thickeners have a moderately high molecular weight: 7 to 30 carbon atoms, preferably 12 to 30 carbon atoms, and most preferably 18 to 22 carbon atoms, such as lauric, myristic, palmitic, stearic, behenic, myristoleic, palmitoleic, oleic, and linoleic acids. Also, vegetable or plant oils such as rapeseed, sunflower, safflower, cottonseed, palm, castor and corn oils and animal oils such as fish oil, hydrogenated fish oil, lard oil, and beef oil can be used as a source of monocarboxylic acids in simple calcium soap thickeners. Various nut oils or the fatty acids derived therefrom may also be used in simple calcium soap thickeners. Most of these oils are primarily triacylglycerides. They may be reacted directly with the calcium containing base or the fatty acids may be cleaved from the triglyceride backbone, separated, and then reacted with the calcium containing base as free acids.

Hydroxy-monocarboxylic acids used in simple anhydrous calcium soap thickeners can include any counterpart to the preceding acids. The most widely used hydroxy-monocarboxylic acids are 12-hydroxystearic acid, 14-hydroxystearic acid, 16-hydroxystearic acid, 6-hydroxystearic acid and 9,10-dihydroxystearic acid. Likewise, any fatty acid derivatives containing any of the hydroxy-carboxylic acids may be used. In general, the monocarboxylic acids and hydroxy-monocarboxylic acids can be saturated or unsaturated, straight or branch chained. Esters, amides, anhydrides, or any other derivative of these monocarboxylic acids can be used in lieu of the free acids in simple anhydrous calcium soap thickeners. The preferred monocarboxylic and hydroxy-monocarboxylic acid derivative is free carboxylic acid, however, other derivatives, such as those described above, can be used depending on the grease processing conditions and the application for which the grease is to be used.

When preparing simple anhydrous calcium soap thickeners by reacting the calcium base and the monocarboxylic acid, or mixture of monocarboxylic acids or derivatives thereof, it is preferred that the calcium base be added in an amount sufficient to react with all the acids and/or acid derivatives. It is also sometimes advantageous to add an excess of calcium base to more easily facilitate a complete reaction. The amount of excess calcium base depends on the severity of processing which the base grease will experience. The longer the base grease is heated and the higher the maximum heat treatment temperature, the less excess calcium base is required. In the preferred front-wheel drive grease, a tricalcium phosphate and calcium carbonate additive system is added as preformed solids during the heat treatment step, and little or no excess calcium base need be added since both tricalcium phosphate and calcium carbonate are basic materials capable of reacting with monocarboxylic acids.

In simple anhydrous calcium soap thickener greases, the thickener forming reaction is usually carried out at somewhat elevated temperatures, 150° F. to 320° F. Water may or may not be added to facilitate a better or more complete reaction. Preferably, any water added at the beginning of the processing as well as water formed from the thickener reaction is evaporated by heat, vacuum, or both. The thickener reaction is generally carried out after the addition of some base oil as previously described. After the thickener has been formed and any water removed, additional base oil can be added to the anhydrous base grease. During preparation, the base grease can be heat treated to a temperature ranging from about 250° F. to about 320° F. The concentration of base grease can be reduced with more base oil, additives, and other ingredients used to produce the finished grease product.

In addition to simple calcium soap thickener, calcium complex soap thickener can be used. Calcium complex soap thickener comprises the same two ingredients described in the simple calcium soap case, namely, a calcium-containing base and monocarboxylic acids, at least part of which should preferably be hydroxy-monocarboxylic acids. Additionally, calcium complex soap thickeners comprise a shorter chain monocarboxylic acid. Esters, amides, anhydrides, or other carboxylic acid derivatives can also be used. The short chain fatty acid in calcium complex soap greases can have from 2 to 12 carbons, preferably 2 to 10, and most preferably 2 to 6. While the short chain acid in calcium complex soap thickener can be alkyl or aryl, unsaturated or saturated, straight chain or branched, alkyl, straight chain, saturated acids are preferred, such as acetic acid, due to its low cost and availability. Propionic acid can also be used with similar results. Butyric, valeric, and caproic acids can be used, but are not preferred in part because of their offensive odors.

In calcium complex soap thickeners, the ratio of short chain acids to long chain acids can vary widely depending on the desired grease yield and dropping point. The lower the ratio of short chain acids to long chain acids, the less will be the dropping point elevation above that of a simple, anhydrous calcium soap grease. The larger the ratio of short chain acid to long chain acid, however, the poorer the grease yield because of the less effective thickening power of the calcium salt of the short chain carboxylic acid.

Processing conditions for manufacture of calcium complex greases are similar to those described for simple calcium greases. An amount of the calcium base is slurried in some of the base oil. Then the long chain monocarboxylic acids and short chain carboxylic acids are added. They may be added together or separately. Water may or may not also be added. If water is added to the thickener, then the water is preferably vaporized or otherwise removed after the thickener has been formed. This can be accomplished by heat, vacuum, or both. Once formed and dried, the calcium complex base grease can be conditioned with a heat treatment step, such as by heating the grease to a temperature ranging from about 250° F. to about 400° F., preferably, to at least about 300° F.

Additives

In order to attain extreme pressure properties, antiwear qualities, and elastomeric compatibility, the additives in the additive package comprise tricalcium phosphate and calcium carbonate. Advantageously, the use of both calcium carbonate and especially tricalcium phosphate in the additive package adsorbs oil in a manner similar to polyurea and, therefore, less polyurea thickener is required to achieve the desired grease consistency. Typically, the cost of tricalcium phosphate and calcium carbonate are much less than polyurea and, therefore, the grease can be formulated at lower costs.

Preferably, the tricalcium phosphate and the calcium carbonate are each present in the additive package in an amount ranging from 2% to 20% by weight of the grease. For ease of handling and manufacture, the tricalcium phosphate and calcium carbonate are each most preferably present in the additive package in less than about 10% by weight of the grease.

Desirably, the maximum particle sizes of the tricalcium phosphate and the calcium carbonate are 100 microns and the tricalcium phosphate and the calcium carbonate are of food-grade quality to minimize abrasive contaminants and promote homogenization. Calcium carbonate can be provided in dry solid form as $CaCO_3$. Tricalcium phosphate can be provided in dry solid form as $Ca_3(PO_4)_2$ or $3Ca_3(PO_4)_2 \cdot Ca(OH)_2$.

If desired, the calcium carbonate and/or tricalcium phosphate can be added, formed, or created in situ in the grease as byproducts of chemical reactions. For example, calcium carbonate can be produced by bubbling carbon dioxide through calcium hydroxide in the grease. Tricalcium phosphate can be produced by reacting phosphoric acid with calcium oxide or calcium hydroxide in the grease. Other methods for forming calcium carbonate and/or tricalcium phosphate can also be used.

The preferred phosphate additive is tricalcium phosphate for best results. While tricalcium phosphate is the preferred, other phosphate additives can be used, if desired, in conjunction with or in lieu of tricalcium phosphate, such as the phosphates of a Group 2*a* alkaline earth metal, such as beryllium, manganese, calcium, strontium, and barium, or the phosphates of a Group 1*a* alkali metal, such as lithium, sodium, and potassium.

Desirably, tricalcium phosphate is less expensive, less toxic, more readily available, safer, and more stable than other phosphates. Tricalcium phosphate is also superior to monocalcium phosphate and dicalcium phosphate. Tricalcium phosphate has unexpectedly been found to be compatible and noncorrosive with elastomers and seals of front-wheel drive joints. Tricalcium phosphate is also water insoluble and will not wash out of the grease when contamination by water occurs. Monocalcium phosphate and dicalcium phosphate, however, were found to corrode, crack, and/or degrade some elastomers and seals of front-wheel drive joints. Monocalcium phosphate and dicalcium phosphate were also undesirably found to be water soluble and wash out of the grease when the front-wheel drive joint was contacted with water, which significantly decreased the antiwear and extreme pressure qualities of the grease.

The preferred carbonate additive is calcium carbonate for best results. While calcium carbonate is preferred, other carbonate additives can be used, if desired, in conjunction with or in lieu of calcium carbonate, such as the carbonates of a Group 2*a* alkaline earth metal, such as beryllium, manganese, calcium, strontium, and barium.

Desirably, calcium carbonate is less expensive, less toxic, more readily available, safer, and more stable than other carbonates. Calcium carbonate is also superior to calcium bicarbonate. Calcium carbonate has been unexpectedly found to be compatible and noncorrosive with elastomers and seals of front-wheel drive joints and is water insoluble. Calcium bicarbonate, on the other hand, has been found to corrode, crack, and/or degrade many of the elastomers and seals of front-wheel drive joints. Calcium bicarbonate has also been undesirably found to be water soluble and experiences many of the same problems as monocalcium phosphate and dicalcium phospate discussed above. Also, calcium bicarbonate is disadvantageous for another reason. During normal use, either the base oil or antioxidant additives will undergo a certain amount of oxidation. The end products of this oxidation are invariably acidic. These acid oxidation products can react with calcium bicarbonate to undesirably produce gaseous carbon dioxide. If the grease is used in a sealed application, such as a constant-velocity joint, the evolution of gaseous reaction products, such as carbon dioxides, could, in extreme cases, cause ballooning of the elastomeric seal. This would in turn place additional stress on the seal and seal clamps and could ultimately result in a seal failure and rupture. Calcium carbonate, however, is much more resistant to producing carbon dioxide, since its alkaline reserve is much higher than calcium bicarbonate.

The use of both tricalcium phosphate and calcium carbonate together in the additive package of the front-wheel drive grease was found to produce unexpected superior results in comparison to a similar grease with greater amounts by weight of: (a) tricalcium phosphate alone in the absence of calcium carbonate, or (b) calcium carbonate alone in the absence of tricalcium phosphate.

Alkali or alkaline earth metal sulfonates overbased with the corresponding alkali or alkaline earth metal carbonate and/or phosphate can also be used as the source of metal carbonate and/or phosphate. Such overbased sulfonates can also be used for emulsification, demulsification, or corrosion inhibition. They are usually liquids and are usually either oil soluble or oil dispersible to form stable mixtures. If one uses an amount of one or more of these materials sufficient to provide the requisite levels of phosphate and carbonate, as described in this invention, the resulting lubricating grease can be expected to have EP/antiwear properties equivalent to that obtained in a grease where the solid phosphate/and or carbonate was added instead. While most overbased alkali or alkaline earth metal sulfonate will work, the most preferred ones will be the ones that are most highly overbased, that is, the ones which have the highest mole ratio of carbonate and/or phosphate per sulfonate. In this way less overbased sulfonate will be required to provide a given level of performance.

EXAMPLE 2

This test served as the control for subsequent tests. A base grease was formulated with about 15% by weight polyurea thickener and about 85% by weight paraffinic solvent base oil. The polyurea thickener was prepared in a vessel in a manner similar to Example 1. The paraffinic solvent base oil was mixed with the polyurea thickener until a homogeneous base grease was obtained. No additive package was added to the base grease. Neither tricalcium phosphate nor calcium carbonate were present in the base grease. The EP (extreme pressure)/antiwear properties of the base grease, comprising the last nonseizure load, weld load, and load wear index were measured using the Four Ball EP method as described in ASTM D2596. The results were as follows:

| | |
|---|---|
| Last nonseizure load, kg | 32 |
| Weld load, kg | 100 |
| Load wear index | 16.8 |

EXAMPLE 3

A front-wheel drive grease was prepared in a manner similar to Example 2, except that about 5% by weight of finely divided, precipitated tricalcium phosphate with an average mean diameter of less than 2 microns was added to the base grease. The resultant mixture was mixed and milled in a roll mill until a homogeneous grease was produced. The Four Ball EP Test showed that the EP/antiwear properties of the grease were significantly increased with tricalcium phosphate.

| | |
|---|---|
| Last nonseizure load, kg | 63 |
| Weld load, kg | 160 |
| Load wear index | 33.1 |

EXAMPLE 4

A front-wheel drive grease was prepared in a manner similar to Example 3, except that about 10% by weight tricalcium phosphate was added to the base grease. The Four Ball EP Test showed that the EP/antiwear properties were further increased with more tricalcium phosphate.

| | |
|---|---|
| Last nonseizure load, kg | 80 |
| Weld load, kg | 250 |
| Load wear index | 44.4 |

EXAMPLE 5

A front-wheel drive grease was prepared in a manner similar to Example 4, except that about 20% by weight tricalcium phosphate was added to the base grease. The Four Ball EP Test showed that the EP/antiwear properties of the grease were somewhat better than the 5% tricalcium phosphate grease of Example 3, but not as good as the 10% tricalcium phosphate grease of Example 4.

| | |
|---|---|
| Last nonseizure load, kg | 63 |
| Weld load, kg | 250 |
| Load wear index | 36.8 |

EXAMPLE 6

A front-wheel drive grease was prepared in a manner similar to Example 2, except that about 5% by weight of finely divided precipitated tricalcium phosphate and about 5% by weight of finely divided calcium carbonate were added to the base grease. The tricalcium phosphate and calcium carbonate had an average mean particle diameter less than 2 microns. The resultant grease was mixed and milled until it was homogeneous. The Four Ball EP Test showed that the EP/antiwear properties of the grease were surprisingly better than the base grease of Example 1 and the tricalcium phosphate greases of Examples 2–5.

| | |
|---|---|
| Last nonseizure load, kg | 80 |
| Weld load, kg | 400 |
| Load wear index | 52.9 |

EXAMPLE 7

A front-wheel drive grease was prepared in a manner similar to Example 6, except that 10% by weight tricalcium phosphate and 10% by weight calcium carbonate were added to the base grease. The Four Ball EP Test showed that the weld load was slightly worse and the load wear index were slightly better than the grease of Example 6.

| | |
|---|---|
| Last nonseizure load, kg | 80 |
| Weld load, kg | 315 |
| Load wear index | 55.7 |

EXAMPLE 8

A front-wheel drive grease was prepared in a manner similar to Example 7, except that 20% by weight tricalcium phosphate and 20% calcium carbonate were blended into the base grease. The Four Ball EP Test showed that the EP/antiwear properties of the grease were better than greases of Examples 6 and 7.

| | |
|---|---|
| Last nonseizure load, kg | 100 |
| Weld load, kg | 500 |
| Load wear index | 85.6 |

EXAMPLE 9

A front-wheel drive grease was prepared in a manner similar to Example 2, except that about 10% by weight of finely divided calcium carbonate with a mean particle diameter less than 2 microns, was added to the base grease. The resultant grease was mixed and milled until it was homogeneous. The Four Ball EP Test showed that the weld load and load wear index of the calcium carbonate grease were better than the base grease of Example 2.

| | |
|---|---|
| Last nonseizure load, kg | 80 |
| Weld load, kg | 400 |
| Load wear index | 57 |

EXAMPLE 10

A front-wheel drive grease wa prepared in a manner similar to Example 6, except that about 3% by weight tricalcium phosphate and about 5% by weight calcium carbonate were added to the base grease. The Four Ball EP Test showed that the weld load and load wear index of the grease were better than the greases of Example 4 (10% tricalcium phosphate alone) and Example 9 (10% calcium carbonate alone), even though the total combined level of additives was only 8%. This result is most surprising and unexpected. It illustrates how the two additives can work together to give the surprising improvements and beneficial results.

| | |
|---|---|
| Last nonseizure load, kg | 80 |
| Weld load, kg | 500 |
| Load wear index | 61.8 |

EXAMPLE 11

The front-wheel drive grease of Example 6 (5% by weight tricalcium phosphate and 5% by weight calcium carbonate) was subjected to the ASTM D4048 Copper Corrosion Test at a temperature of 300° F. No significant corrosion appeared. The copper test sample remained bright and shiny. The grease was rated 1*a*.

EXAMPLE 12

The front-wheel drive grease of Example 10 (3% by weight tricalcium phosphate and about 5% by weight calcium carbonate) was subjected to the ASTM D4048 Copper Corrosion Test at a temperature of 300° F. The results were similar to Example 11.

EXAMPLE 13

A front-wheel drive grease was prepared in a manner similar to Example 6, except that about 3.5% by weight tricalcium phosphate, about 3.5% by weight calcium carbonate, and about 7% by weight of an insoluble arylene sulfide polymer, manufactured by Phillips Petroleum Company under the trade name RYTON, were added to the base grease. The grease containing insoluble arylene sulfide polymer was subjected to the ASTM D4048 Copper Corrosion Test at a temperature of 300° F. and failed miserably. Significant corrosion appeared. The copper test strip was spotted and colored and was rated 3*b*.

EXAMPLE 14

A front-wheel drive grease was prepared in a manner similar to Example 3, except as follows. The base oil comprised about 60% by weight of 850 SUS paraffinic, solvent extracted, hydrogenated mineral oil, and about 40% by weight of 350 SUS paraffinic, solvent extracted, hydrogenated mineral oil. The base grease comprised 16.07% polyurea thickener. Instead of adding tricalcium phosphate, 11.13 grams of feed grade monocalcium phosphate and dicalcium phospate, sold under the brand name of Biofos by IMC, were added to the base grease. The resultant grease was milled in a manner similar to Example 2 and subjected to an Optimol SRV stepload test (described in Example 19). The test grease failed: The coefficient of friction slipped. The disk was rough and showed a lot of wear.

EXAMPLE 15

The grease of Example 13 containing oil-insoluble arylene polymers was subjected to the ASTM D4170 Fretting Wear Test and an Elastomer Compatibility Test for Silicone at 150° C. for 312 hours. The results were as follows:

| | |
|---|---|
| Fretting Wear, ASTM D4170, 72 hr mg loss/race set | 5.6 |
| Elastomer Compatibility with Silicone | |
| % loss tensile strength | 17.4 |
| % loss total elongation | 16.9 |

EXAMPLE 16

The front-wheel drive grease of Example 6 was subjected to the ASTM D4170 Fretting Wear Test and an Elastomer Compatibility Test for Silicone at 150° C. for 312 hours. The grease displayed substantially better fretting resistance and elastomer compatibility than the grease of Example 15 containing insoluable arylene polymers.

| | |
|---|---|
| Fretting Wear, ASTM D4170, 72 hr mg loss/race set | 3.0 |
| Elastomer Compatibility with Silicone | |
| % loss tensile strength | 9.9 |
| % loss total elongation | 12.2 |

EXAMPLE 17

A front-wheel drive grease was prepared in a manner similar to Example 6, except as described below. The polyurea thickener was prepared in a manner similar to Example 1 by reacting 676.28 grams of a fatty amine, sold under the brand name Armeen T by Armak Industries Chemicals Division, 594.92 grams of a diisocyanate, sold under the brand name Mondur CD by Mobay Chemical Corporation, and 536 ml of water. The base oil had a viscoscity of 650 SUS at 100° F. and was a mixture of 850 SUS paraffinic, solvent extracted, hydrogenated mineral oil, and hydrogenated solvent extracted, dewaxed, mineral oil. Corrosive inhibiting agents, sold under the brand names of Nasul BSN by R. T. Vanderbilt Co. and Lubrizol 5391 by the Lubrizol Corp., were added to the grease for ferrous corrosion protection. The antioxidants were a mixture of arylamines. The grease was stirred and subsequently milled through a Gaulin Homogenizer at a pressure of 7000 psi until a homogeneous grease was produced. The grease had the following composition:

| Component | % (wt) |
|---|---|
| 850 SUS Oil | 47.58 |
| 350 SUS Oil | 31.20 |
| Polyurea Thickener | 9.50 |
| Tricalcium Phosphate | 5.00 |
| Calcium Carbonate | 5.00 |
| Nasul BSN | 1.00 |
| Lubrizol 5391 | 0.50 |
| Mixed Aryl Amines | 0.20 |
| Dye | 0.02 |

The grease was tested and had the following performance properties:

| | |
|---|---|
| Work Penetration, ASTM D217 | 307 |
| Dropping Point, ASTM D2265 | 501° F. |
| Four Ball Wear, ASTM D2266 at 40 kg, 1200 rpm for 1 hr | 0.50 |
| Four Ball EP, ASTM D2596 | |
| last nonseizure load, kg | 80 |
| weld load, kg | 400 |
| load wear index | 57 |
| Timken, ASTM D4170, lbs | 60 |
| Fretting Wear, ASTM D4170, 24 hr mg loss/race set | 0.8 |
| Corrosion Prevention Test, ASTM D1743 | 1 |
| Elastomer Compatibility with Polyester | |
| % loss tensile strength | 21.8 |
| % loss maximum elongation | 12.9 |
| Elastomer Compatibility with Silicone | |
| % loss tensile strength | 7.4 |
| % loss maximum elongation | 24.2 |

EXAMPLE 18

The grease of Example 17 was subjected to an oil separation and cone test (bleed test), SDM 433 standard test of the Saginaw Steering Gear Division of General Motors. In the test, the grease was placed on a 60 mesh nickel screen cone. The cone was heated in an oven for the indicated time at the listed temperature. The percentage decrease in the weight of the grease was measured. The test showed that minimum oil loss occurred even at higher temperaures over a 24-hour time period. The results were as follows:

| time (hr) | temp (°F.) | % oil loss |
|---|---|---|
| 6 | 212 | 1.9 |
| 24 | 212 | 4.4 |
| 24 | 300 | 2.1 |
| 24 | 350 | 3.4 |

EXAMPLE 19

The grease of Example 17 was subjected to an Optimol SRV stepload test under conditions recommended by Optimol Lubricants, Inc. and used by Automotive Manufacturers such as General Motors for lubricant evaluation. This method was also specified by the U.S. Air Force Laboratories Test Procedure of March 6, 1985. In the test, a 10 mm steel ball is oscillated under load increments of 100 newtons on a lapped steel disc lubricated with the grease being tested until seizure occurs. The grease passed the maximum load of 900 newtons.

EXAMPLE 20

A calcium complex base grease was prepared in a laboratory grease kettle as follows: 1,184.94 grams of calcium hydroxide was slurried in 19.0 pounds of a hydrofinished, solvent extracted, 850 SUS, paraffinic mineral oil at about 140° F. The temperature was then increased to 170° F. and 717.32 grams of methyl 12-hydroxystearate and 2024.84 grams of hydrogenated fatty acids were added. The temperature was kept at about 170° F. during the reaction. After the reaction appeared over, 1153.16 grams of glacial acetic acid was added and mixed for thirty minutes. The grease was then heated to 310° F. until all water from the reaction had volatilized and the grease was dry. The kettle was then closed and the grease was heated and stirred under vacuum for 30 minutes. Then the kettle was opened and an additional 6.0 pounds of the hydrofinished, solvent extracted, 850 SUS, paraffinic mineral oil was slowly added while stirring the grease. When the final base grease was well mixed and smooth, it was cooled to 200° F., removed from the grease kettle and stored in a container.

EXAMPLE 21

This grease served as the control for subsequent tests involving calcium complex thickened greases. A 11.54 gram quantity of the base oil used in Example 20 was added to 150 grams of the base calcium complex grease of Example 20. The mixture was milled in a roll mill until a homogeneous grease was obtained. This grease which contained no additives was then subjected to a Four Ball EP test. The results were as follows:

| | |
|---|---|
| Last nonseizure load, kg | 100 |
| Weld load, kg | 200 |
| Load wear index | 42.2 |

EXAMPLE 22

A front-wheel drive grease was prepared in a manner similar to Example 21, except that about 5% by weight of finely divided, precipitated tricalcium phosphate with a mean diameter of less than 2 microns was added to the base grease. The resultant mixture was mixed and milled in a roll mill until a homogeneous grease was produced. The Four Ball EP test showed improvement with the use of tricalcium phosphate.

| | |
|---|---|
| Last nonseizure load, kg | 80 |
| Weld load, kg | 250 |
| Load wear index | 43.2 |

EXAMPLE 23

A front-wheel drive grease was prepared similar to the manner of Example 22, except that 10% by weight tricalcium phosphate was added to the base grease. The Four Ball EP showed further improvements in EP/antiwear properties.

| | |
|---|---|
| Last nonseizure load, kg | 80 |
| Weld load, kg | 315 |

-continued

| | |
|---|---|
| Load wear index | 46.7 |

EXAMPLE 24

A front-wheel drive grease was prepared similar to the manner of Example 23, except that 10% by weight of finely divided, precipitated calcium carbonate was added to the grease. The mean particle diameter of the calcium carbonate was less than 2 microns. Four Ball EP test results showed improvement over the calcium complex base grease of Example 21.

| | |
|---|---|
| Last nonseizure load, kg | 80 |
| Weld load, kg | 400 |
| Load wear index | 61.9 |

EXAMPLE 25

A front-wheel drive grease was prepared similar to the manner of Example 24, except that 3% by weight of tricalcium phosphate and 5% by weight of calcium carbonate were added to the base grease. The Four Ball EP test results showed that this grease with a total additive level of 8% was superior to the greases of Examples 23 and 24, even though the total levels of additives in those two greases were both 10%. Therefore, the combination of tricalcium phosphate and calcium carbonate at a given total level gave results superior to that of either additive alone at a 25% higher level. This result is surprising and unexpected and was not anticipated or obvious from prior art greases.

| | |
|---|---|
| Last nonseizure load, kg | 80 |
| Weld load, kg | 400 |
| Load wear index | 64.1 |

EXAMPLE 26

A front-wheel drive grease was prepared similar to the manner of Example 23, except that 12% by weight of tricalcium phosphate was added to the base grease. The Optimol SRV Stepload test of Example 19 was performed. The grease successfully withstood a 1,100 newton load for the required two minutes but failed when an attempt was made to increase the load to 1,200 newtons.

EXAMPLE 27

A front-wheel drive grease was prepared similar to the manner of Example 26, except that 12% by weight of calcium carbonate was added to the base grease. The Optimol SRV test of Example 26 was performed. The grease successfully passed a 1,100 newton load for the required two minutes but failed when an attempt was made to increase the load to 1,200 newtons.

EXAMPLE 28

A front-wheel drive grease was prepared similar to the manner of Examples 26 and 27, except that 5% by weight of tricalcium phosphate and 5% by weight of calcium carbonate were added to the base grease. The Optimol SRV test of Example 27 was performed. The grease successfully passed 1,200 newtons for the required two minutes. Since the machine design prevented higher loading, the 1,200 newton load was maintained after the required two minutes for an additional six minutes. Thus this grease with 10% total additives of tricalcium phosphate and calcium carbonate outperformed the greases of both Examples 26 and 27, even though both of those greases had 12% of either tricalcium phosphate or calcium carbonate alone. These outstanding results in calcium complex soap thickened greases were both surprising and unexpected, since the combination of tricalcium phosphate and calcium carbonate at a given total level gave results superior to that of either additive alone at a 20% higher level. This result is neither anticipated nor obvious from prior art greases.

EXAMPLE 29

A front-wheel drive grease was prepared similar to the manner of Example 28, except that 10% by weight of tricalcium phosphate and 10% by weight of calcium carbonate were added to the base grease. The grease was subjected to the Four Ball EP test. The results were superior to that of the calcium complex soap base grease of Example 21.

| | |
|---|---|
| Last nonseizure load, kg | 80 |
| Weld load, kg | 620 |
| Load wear index | 72.9 |

EXAMPLE 30

A front-wheel drive grease was prepared similar to the manner of Example 29, except that 20% by weight of tricalcium phosphate and 20% by weight of calcium carbonate was added to the base grease. The grease was subjected to the Four Ball EP test. Results were again superior to that of the calcium complex soap base grease of Example 21.

| | |
|---|---|
| Last nonseizure load, kg | 20 |
| Weld load, kg | 500 |
| Load wear index | 93.1 |

EXAMPLE 31

A front-wheel drive grease was prepared similar to the manner of Example 30, except that only 20% by weight of tricalcium phosphate was added to the base grease. In this example, calcium carbonate was not added to the base grease. The grease was subjected to the Four Ball EP test. Results were again superior to that of the calcium complex soap base grease of Example 21.

| | |
|---|---|
| Last nonseizure load, kg | 20 |
| Weld load, kg | 400 |
| Load wear index | 63.7 |

EXAMPLE 32

A front-wheel drive grease was prepared similar to the manner of Example 30, except that 2% by weight of tricalcium phosphate and 2% by weight of calcium carbonate was added to the base grease. The grease was subjected to the Four Ball EP test. Results were again superior to the calcium complex soap base grease of Example 21.

| | |
|---|---|
| Last nonseizure load, kg | 80 |
| Weld load, kg | 250 |
| Load wear index | 43.2 |

EXAMPLE 33

Another calcium complex base grease was prepared in a manner similar to that of Example 20. A portion of the base grease was removed from the grease kettle and stored for use in Example 34. To the remaining base grease, additives and base oil were added and the resulting grease was milled using a Charlotte Mill with a gap clearance of 0.0005 inches. A smooth product resulted with the following composition:

| Component % (wt) | |
|---|---|
| 850 SUS Oil | 70.05 |
| Calcium Complex Thickener | 18.25 |
| Tricalcium Phosphate | 5.00 |
| Calcium Carbonate | 5.00 |
| Nasul BSN | 1.00 |
| Lubrizol 5391 | 0.50 |
| Mixed Aryl Amines | 0.20 |

The grease was tested and had the following performance properties:

| | |
|---|---|
| Work Penetration, ASTM D217 | 317 |
| Dropping Point, °F., ASTM D2265 | 500+ |
| Oil Separation, %, SDM 433 (See Example 18) | |
| 6 hr, 212° F. | 0.68 |
| 24 hr, 212° F. | 1.36 |
| 24 hr, 300° F. | 1.34 |
| 24 hr, 350° F. | 2.37 |
| Four Ball Wear, mm, ASTM D2266 at 40 kg, 1,200 rpm, 167° F., 1 hour | 0.44 |
| Four Ball EP, ASTM D2596 | |
| last nonseizure load, kg | 80 |
| weld load, kg | 400 |
| load wear index | 57.4 |
| Fretting Wear, ASTM D4170, 24 hr mg loss/race set | 10.6 |
| Optimol SRV Stepload Test, 80° C. | 1,100 |
| Corrosion Prevention Test, ASTM D1743 | Pass 1 |
| Elastomer Compatibility with Polyester | |
| % loss tensile strength | 10.8 |
| % loss maximum elongation | 4.3 |
| Elastomer Compatibility with Silicone | |
| % loss tensile strength | 20.2 |
| % loss maximum elongation | 13.4 |

As can be seen above, the test results for the calcium complex soap grease of Example 33 are excellent. Fretting wear is quite high, however, when compared with the polyurea thickened grease of Example 17. Since the only significant difference in composition between the greases of Examples 17 and 33 is the type of thickener used, the cause of the high fretting wear has to do with the calcium complex thickener and not the tricalcium phosphate and calcium carbonate additive system. More proof of this fact and a way where by it can be advantageously exploited is given in Example 34.

EXAMPLE 34

A front-wheel drive grease was prepared in a manner similar to that of Example 33, using the unused portion of the Example 33 calcium complex base grease. This time, however, before any additives or base oil were added, polyurea thickened base grease was added to the calcium complex base grease in the grease kettle. The amount of polyurea thickened base grease added was sufficient to give a new base grease with equal weights of calcium complex and polyurea thickener. The new polyurea/calcium complex base grease was then finished with additives and additional base oil, and then milled in a manner similar to Example 33. A smooth product resulted with the following composition:

| Component % (wt) | |
|---|---|
| 850 SUS Oil | 75.05 |
| Calcium Complex Thickener | 6.63 |
| Polyurea Thickener | 6.62 |
| Tricalcium Phosphate | 5.00 |
| Calcium Carbonate | 5.00 |
| Nasul BSN | 1.00 |
| Lubrizol 5391 | 0.50 |
| Mixed Aryl Amines | 0.20 |

The grease was tested and had the following performance properties:

| | |
|---|---|
| Work Penetration, ASTM D217 | 307 |
| Dropping Point, °F., ASTM D2265 | 500+ |
| Oil Separation, %, SDM 433 (See Example 18) | |
| 6 hr, 212° F. | 1.59 |
| 24 hr, 212° F. | 1.66 |
| 24 hr, 300° F. | 1.46 |
| 24 hr, 350° F. | 1.56 |
| Four Ball Wear, mm, ASTM D2266 at 40 kg, 1,200 rpm, 167° F., 1 hour | 0.41 |
| Four Ball EP, ASTM D2596 | |
| last nonseizure load, kg | 80 |
| weld load, kg | 500 |
| load wear index | 63.01 |
| Fretting Wear, ASTM D4170, 24 hr mg loss/race set | 1.6 |
| Optimol SRV Stepload Test, 80° C. | 1,100 |
| Corrosion Prevention Test, ASTM D1743 | Pass 1 |
| Elastomer Compatibility with Polyester | |
| % loss tensile strength | 14.6 |
| % loss maximum elongation | 3.2 |
| Elastomer Compatibility with Silicone | |
| % loss tensile strength | 27.1 |
| % loss maximum elongation | 20.5 |

The test results for the polyurea and calcium complex soap thickened grease of Example 34 are excellent. Examination of the fretting wear of this grease yields further proof that the higher fretting wear of Example 33 compared to Example 17 was due to the calcium complex thickener. By effectively replacing half of the calcium complex thickener with polyurea thickener, and without changing any other compositional aspect of the grease, fretting wear was dramatically reduced. Moreover, comparison of the fretting wear properties of this grease with that of Examples 17 and 33 show that this grease cannot be considered simply a mixture of calcium complex thickened and polyurea thickened greases. Although this grease has 50% by weight of its thickener as calcium complex, its fretting wear value is shifted 91.8% towards the value obtained by the 100% polyurea thickened grease of Example 17. This is important since calcium complex soap is usually much less expensive than polyurea. This outstanding result is both surprising and unexpected and was not anticipated or obvious from prior art greases.

EXAMPLE 35

To further illustrate the utility of a tricalcium phosphate and calcium carbonate system, a grease similar to that of Example 33 was made except a calcium complex base grease was not used. Instead a simple calcium 12-hydroxystearate base grease was used. This simple calcium 12-hydroxystearate grease was formulated using a similar procedure as was generally described earlier. Additives and oil were added to the base grease and the resulting grease was milled using a Charlotte Mill with a gap clearance of 0.0005 inches. A smooth grease was obtained with the following composition:

| Component % (wt) | |
|---|---|
| 850 SUS Oil | 82.30 |
| Calcium 12-Hydroxystearate Thickener | 6.00 |
| Tricalcium Phosphate | 5.00 |
| Calcium Carbonate | 5.00 |
| Nasul BSN | 1.00 |
| Lubrizol 5391 | 0.50 |
| Mixed Aryl Amines | 0.20 |

The grease was tested and had the following performance properties:

| | |
|---|---|
| Work Penetration, ASTM D217 | 333 |
| Dropping Point, °F., ASTM D2265 | 373+ |
| Oil Separation, %, SDM 433 (See Example 18) | |
| 6 hr, 212° F. | 3.8 |
| 24 hr, 212° F. | 5.9 |
| 24 hr, 300° F. | 18.4 |
| Four Ball Wear, mm, ASTM D2266 at 40 kg, 1,200 rpm, 167° F., 1 hour | 0.40 |
| Four Ball EP, ASTM D2596 | |
| last nonseizure load, kg | 80 |
| weld load, kg | 400 |
| load wear index | 47.6 |
| Fretting Wear, ASTM D4170, 24 hr mg loss/race set | 0.09 |
| Optimol SRV Stepload Test, 80° C. | 600 |
| Corrosion Prevention Test, ASTM D1743 | Pass 1 |
| Elastomer Compatibility with Polyester | |
| % loss tensile strength | 18.6 |
| % loss maximum elongation | 9.1 |

The test results for the simple calcium soap thickened grease of Example 35 are very good, although some properties are not as good as those of Examples 17, 33, and 34. For example, the dropping point of this simple calcium soap thickened grease was lower when compared to greases thickened with polyurea or calcium complex thickener. Similarly, the EP/antiwear properties of this simple calcium soap thickened grease are, for the most part, not as good as those of Example 17, 33, and 34. Even so, they are significantly better than those of base greases which contain no additives, such as Examples 2 and 21.

Among the many advantages of the novel front-wheel drive grease are:

1. High performance on front-wheel drive joints.
2. Superior fretting wear protection.
3. Excellent oil separation qualities, even at high temperatures.
4. Remarkable compatibility and protection of elastomers and seals of front-wheel drive joints.
5. Greater stability at high temperatures for long periods of time.
6. Nontoxic.
7. Safe.
8. Economical.

Although embodiments of this invention have been described, it is to be understood that various modifications and substitutions can be made by those skilled in the art without departing from the novel spirit and scope of this invention.

What is claimed is:

1. A lubricating grease comprising:

a base oil;

an additive package comprising a combined carbonate and phosphate additive package, said combined additive package comprising both a carbonate and a phosphate in the absence of sulfur-containing compounds comprising arylene sulfide polymers, said carbonate selected from the group consisting of a carbonate of a Group 2*a* alkaline earth metal and a carbonate of a Group 1*a* alkali metal, said phosphate selected from the group consisting of a phosphate of a Group 2*a* alkaline earth metal and a phosphate of a Group 1*a* alkali metal, said alkaline earth metal selected from the group consisting of beryllium, magnesium, calcium, strontium, and barium, and said alkali metal selected from the group consisting of lithium, sodium, and potassium; and a blended thickener comprising a urea-containing thickener selected from the group consisting of monourea, diurea, and polyurea; and a calcium-containing thickener comprising an anhydrous simple calcium soap.

2. A lubricating grease in accordance with claim 1 wherein said urea-containing thickener and said calcium-containing thickener range from about 1% to about 20% by weight of said grease, said calcium-containing thickener comprises a reaction product obtained by reacting a calcium based material and a compound comprising a source of monocarboxylic acid or a derivative thereof, said calcium based material selected from the group consisting of calcium oxide, calcium carbonate, calcium bicarbonate, and calcium hydroxide, and said compound selected from the group consisting of hydroxystearic acid, lauric acid, myristic acid, palmitic acid, behenic acid, myristoleic acid, palmitoleic acid, oleic acid, linoleic acid, castor oil, vegetable oil, plant oil, fish oil, beef oil, animal oil, lard oil, nut oil, and triacylglyceride compounds.

3. A lubricating grease in accordance with claim 1 wherein said base oil comprises a member selected from the group consisting of naphthenic oil, paraffinic oil, aromatic oil, and a synthetic oil, said synthetic oil comprising a member selected from the group consisting of a polyalphaolefin, a polyester, a diester, a polyether, a polyolether, and fluorinated compounds thereof.

4. A lubricating grease in accordance with claim 1 wherein said base oil comprises a mixture of two different refined, solvent-extracted, hydrogenated, dewaxed base oils.

5. A lubricating grease in accordance with claim 1 wherein said base oil comprises about 60% by weight of a 850 SUS refined solvent-extracted hydrogenated dewaxed base oil and about 40% by weight of a 350 SUS refined solvent-extracted hydrogenated dewaxed base oil.

6. A lubricating grease in accordance with claim 1 wherein said calcium-containing thickener comprises a reaction product of a calcium base material selected from the group consisting of calcium oxide, calcium carbonate, calcium bicarbonate, and calcium hydroxide and a monocarboxylic acid selected from the group consisting of 12-hydroxystearic acid, 14-hydroxystearic acid, 16-hydroxystearic acid, 6-hydroxystearic acid, and 9,10-dihydroxystearic acid.

* * * * *

UNITED STATES PATENT AND TRADEMARK OFFICE

CERTIFICATE OF CORRECTION

PATENT NO. : 4,902,435

DATED : February 20, 1990

INVENTOR(S) : John A. Waynick

It is certified that error appears in the above-identified patent and that said Letters Patent is hereby corrected as shown below:

| Col. | Line | |
|---|---|---|
| 1 | 12 | "1986" should read --1987--. |
| 6 | 13 | "C1-C4" should read --$C_1$-$C_4$--. |
| 7 | 58 | "dodecylisocyante" should read --dodecylisocyanate--. |
| 16 | 13 | "dicalcium phospate" should read --dicalcium phosphate--. |
| 16 | 62 | "viscoscity" should read --viscosity--. |
| 17 | 48 | "temperaures" should read --temperatures--. |

Signed and Sealed this

Fourth Day of May, 1993

*Attest:*

Michael K. Kirk

MICHAEL K. KIRK

*Attesting Officer*

*Acting Commissioner of Patents and Trademarks*